US006509880B2

(12) United States Patent
Sabet et al.

(10) Patent No.: US 6,509,880 B2
(45) Date of Patent: Jan. 21, 2003

(54) INTEGRATED PLANAR ANTENNA PRINTED ON A COMPACT DIELECTRIC SLAB HAVING AN EFFECTIVE DIELECTRIC CONSTANT

(75) Inventors: Kazem F Sabet, Ann Arbor, MI (US); Kamal Sarabandi, Ann Arbor, MI (US); Linda P. B. Katehi, Northville, MI (US); Tayfun Ozdemir, Ann Arbor, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 0 days.

(21) Appl. No.: 09/838,711

(22) Filed: Apr. 19, 2001

(65) Prior Publication Data

US 2002/0057220 A1 May 16, 2002

Related U.S. Application Data

(63) Continuation-in-part of application No. PCT/US99/24526, filed on Oct. 20, 1999, and a continuation-in-part of application No. 09/178,118, filed on Oct. 23, 1998, now Pat. No. 6,081,239.

(51) Int. Cl.[7] ..... H01Q 13/10; H01Q 13/12

(52) U.S. Cl. ..... 343/770; 343/700 MS; 343/769

(58) Field of Search ..... 343/767, 769, 343/770, 700 MS, 795, 895, 753, 911 L, 911 R

(56) References Cited

U.S. PATENT DOCUMENTS

| | | | | |
|---|---|---|---|---|
| 3,002,190 A | 9/1961 | Oleesky et al. | ..... | 343/872 |
| 3,886,558 A | 5/1975 | Cary et al. | ..... | 343/708 |
| 3,914,769 A | 10/1975 | Andrews | ..... | 343/911 R |
| 4,021,812 A | 5/1977 | Schell et al. | ..... | 343/753 |
| 4,467,329 A | 8/1984 | Thal, Jr. | ..... | 343/753 |
| 4,554,549 A | 11/1985 | Fassett et al. | ..... | 343/700 MS |
| 5,017,939 A | 5/1991 | Wu | ..... | 343/911 R |
| 5,103,241 A | 4/1992 | Wu | ..... | 343/909 |
| 5,177,496 A | 1/1993 | Arimura et al. | ..... | 343/771 |
| 5,319,377 A | 6/1994 | Thomas et al. | ..... | 343/700 MS |
| 5,337,058 A | 8/1994 | Cross | ..... | 343/753 |
| 5,398,037 A | 3/1995 | Engheta et al. | ..... | 343/872 |
| 5,497,168 A | 3/1996 | Thomas et al. | ..... | 343/834 |
| 5,563,616 A | 10/1996 | Dempsey et al. | ..... | 343/753 |
| 5,600,342 A | 2/1997 | Pikulski et al. | ..... | 343/909 |
| 5,606,335 A | 2/1997 | English et al. | ..... | 343/909 |
| 5,661,499 A | 8/1997 | Epshtein et al. | ..... | 343/911 R |
| 5,680,139 A | 10/1997 | Huguenin et al. | ..... | 342/175 |
| 5,714,961 A | 2/1998 | Kot et al. | ..... | 343/769 |
| 5,874,922 A | 2/1999 | Tanaka | ..... | 343/753 |

*Primary Examiner*—Tan Ho
(74) *Attorney, Agent, or Firm*—John A. Miller, Esq.; Warn, Burgess & Hoffman, P.C.

(57) ABSTRACT

An integrated planar antenna including a metalized ground plane printed on a dielectric slab. One or more slot antenna elements are etched into the metalized layer, and resonate at a particular resonant frequency band. A plurality of voids extend through the slab and act to vary the dielectric constant of the slab so that resonant waves are suppressed in the slab, thus reducing power loss in the antenna. The voids can be selectively localized in the slab to provide various functions, such as impedance matching and reduction of antenna element coupling. The voids can take on any shape and configuration in accordance with a particular antenna design scheme so as to optimize the effective dielectric constant for a particular application. In one particular design, the voids are formed in a random manner completely through slab, and the voids have an opening diameter less than 1/20th of the operational wavelength of the antenna. The voids are formed by a suitable mechanical or laser drilling operation.

26 Claims, 6 Drawing Sheets f=1.073GHz

INTEGRATED PLANAR ANTENNA PRINTED ON A COMPACT DIELECTRIC SLAB HAVING AN EFFECTIVE DIELECTRIC CONSTANT

CROSS REFERENCE TO RELATED APPLICATIONS

This is a Continuation-in-Part application of international application PCT/US99/24526, filed Oct. 20, 1999, published under PCT Article 21(2) in English, and U.S. patent application Ser. No. 09/178,118, filed Oct. 23, 1998, now U.S. Pat. No. 6,081,239 issued Jun. 27, 2000.

BACKGROUND OF THE INVENTION

1. Field of the Invention

This invention relates generally to an integrated planar printed antenna and, more particularly, to a compact, integrated planar printed antenna that includes a metalization layer formed on a dielectric slab and voids extending through the slab that control the effective dielectric constant of the slab across the antenna aperture to reduce or eliminate surface waves and/or standing waves in the slab to increase antenna performance.

2. Discussion of the Related Art

Current wireless communications systems, including radio frequency systems, global positioning systems (GPS), cellular telephone systems, personal communications systems (PCS), etc., typically require broadband antennas that are compact in size, low in weight and inexpensive to produce. Currently, radio frequency systems use the 20–400 MHz range, GPS use the 1–1.5 GHz range, cellular telephone systems use the 900 MHz range, and PCS use the 1800–2000 MHz range. The antennas receive and transmit electromagnetic signals at the frequency band of interest associated with the particular communications system in an effective manner to satisfy the required transmission and reception functions. Different communications systems require different antenna optimization parameters and design concerns to satisfy the performance expectations of the system.

The antennas necessary for the above-mentioned communications systems pose unique problems when implemented on a moving vehicle. The transmission and reception of electromagnetic waves into and out of a vehicle for different communications systems is generally accomplished through several antennas usually in the form of metallic masts protruding from the vehicle's body. However, mast antennas have significant drawbacks in this type of environment. In a typical design, the linear dimensions of a monopole mast antenna are directly proportional to the operational wavelength A of the system, and are usually a quarter wavelength for high performance purposes. Thus, at the lower end of the frequency spectrum, the size of a high-efficiency antenna becomes prohibitively large. For example, a monopole mast antenna used in the 800 MHz range should be around 10 cm long. Current military wireless communications systems use HF/UHFNHF frequency bands, in addition to cellular telephone systems, GPS and PCS. For military communications in the 20 MHz range, the size of a high performance antenna is in the 4 m range. For military vehicles, mast antennas increase the vehicle's radar visibility, and thus reduce its survivability.

Further, when using multiple antennas to satisfy several communication systems, electromagnetic interference (EMI) between the antennas may become a problem. If the antennas are formed on a common substrate, the antenna signals tend to couple to each other and deteriorate the system's performance and signal-to-noise ratio. Thus, the design of multifunction antennas for military and commercial vehicles tends to pose major challenges with regard to the antenna size, radiation efficiency, fabrication costs, as well as other concerns.

To obviate the drawbacks of mast antennas, it is known in the art to employ planar antennas, including slot, microstrip, and aperture type designs, all well known in the art for a variety of communications applications in the above-mentioned frequency bands, primarily due to the simplicity, conformability, low manufacturing costs and the availability of design and analysis software for such antenna designs. FIG. 1 shows a perspective view of a planar slot ring antenna 10 depicting this type of design, and is intended to represent all types of planar antenna designs. The ring antenna 10 includes a substrate 12 and a conductive metalized layer 14 printed on a top surface of the substrate 12. The layer 14 is patterned by a known patterning process to etch out a ring 16, and define a circular center antenna element 18 and an outside antenna element 20 on opposite sides of the ring 16. The antenna elements 18 and 20 are excited and generate currents by received electromagnetic radiation for reception purposes, or by a suitable transmission signal for transmission purposes, that create an electromagnetic field across the ring 16. A signal generator 22 is shown electrically connected to an antenna feed element 24 patterned on an opposite side of the substrate 12 from the layer 14. The signal generator 22 generates the signal for transmission purposes and receives the signal for reception purposes.

The antenna 10 is a slot antenna because no conductive plane is provided opposite to the layer 14. This allows the antenna 10 to operate with a relatively wide operational bandwidth compared to a metal backed antenna configuration. However, the absence of a metallic ground plane results in radiation into both sides of the antenna, hence, bidirectional operation. In order to direct the radiation into one side of the antenna (unidirectionally), a high dielectric constant superstrate can be employed. FIG. 2 shows a cross-sectional view of the antenna 10 where a superstrate 26 having a high constant $\epsilon_r$ has been positioned on the layer 14, opposite to the substrate 12, to direct the radiation through the substrate 26. The higher the dielectric constant $\epsilon_r$ of the superstrate 26, the more directional the antenna 10.

In addition to providing unidirectionality, a high dielectric constant superstrate leads to antenna size reduction. The linear dimensions of planar antennas are directly proportional to the operational wavelength of the system. The transmission wavelength $\lambda$ of electromagnetic radiation propagating through a medium is determined by the relationship:

$$\lambda = \frac{C}{f\sqrt{\epsilon_r}} \tag{1}$$

where C is the speed of light, f is the frequency of the radiation and $\epsilon_r$ is the relative dielectric constant or relative permittivity of the medium. For air, $\epsilon_r=1$. In this context, the dielectric constant $\epsilon_r$ and the index of refraction n can be used interchangeably, since $\epsilon_r=n^2$. To significantly reduce the size of the antenna 10 for miniaturization purposes at a particular operational wavelength, it is known to position the superstrate 26 adjacent the layer 14 and make the superstrate 26 out of a high dielectric constant material, so that when the electromagnetic radiation travels through the superstrate 26, the wavelength is decreased in accordance with equation (1). This is because the guided wavelength along the antenna elements 18 and 20 is inversely proportional to the square root of the effective dielectric constant $\epsilon_{eff}$, which in turn is related to the relative dielectric constant $\epsilon_r$ of the superstrate 26. The exact relationship depends on the particular geometry of the elements of the antenna 10. The dimensions of the antenna 10 would be well known to those skilled in the art for particular frequency bands of interest. By continually increasing the dielectric constant $\epsilon_r$, the size of the antenna 10 can be further reduced for operation at a particular frequency band.

The use of a high dielectric constant superstrate is highly effective in reducing the size of the antenna so that it is practical for many high and low frequency communications applications. However, the use of high dielectric constant superstrates has a major drawback. It is known that planar antenna designs that employ high index substrates or superstrates have a significantly degraded performance due to the generation of surface waves and resonant or standing waves within the substrate or superstrate. These waves are generated because electromagnetic waves are reflected by dielectric interfaces, and are eventually trapped in the substrate 12 or superstrate 26 in the form of surface waves. The trapped waves carry a large amount of electromagnetic power along the interface and significantly reduce the radiated power from the antenna 10. The power carried by the excited surface waves is a function of the substrate 12 or the superstrate 26. Additionally, the substrate 12 and/or superstrate 26 have the dimensions that cause standing waves within these layers as a result of resonance at the operational frequencies that also adversely affects the power output of the electromagnetic waves.

Consequently, an antenna printed on or covered by a high index material layer of the type described above, may have one or more of low efficiency, narrow bandwidth, degraded radiation pattern and undesired coupling between the various elements in array configurations. A few approaches have been suggested in the art to resolve the excitation of substrate modes in these types of materials, either by physical substrate alterations, or by the use of a spherical lens placed on the substrate 12. In all cases, the radiation efficiency is increased and antenna patterns are improved considerably as a result of the elimination of the surface wave propagation. However, all of these implementations have either resulted in non-monolithic designs or have been characterized by large volume and intolerable high costs.

The need to eliminate and/or reduce surface waves and standing waves in the superstrate region of a planar antenna of the type described above is critical for high antenna performance. To reduce these waves, it has been proposed by two of the inventors to replace the superstrate 26 with a planar superstrate having a graded index of refraction. The superstrate is formed from high index of refraction composite materials that are graded along one or both of the axial and radial directions. By grading the dielectric constant of the superstrate 26 in one or both of the axial and radial directions, the electromagnetic waves propagating through the superstrate 26 encounter dielectric interfaces that alter the symmetry of the superstrate 26, and prevent the standing waves. Because of the lensing action of the superstrate 26, surface waves associated with traditional planar antennas printed on high index materials are suppressed causing the antenna efficiencies to increase dramatically.

FIGS. 3 and 4 depict this design by showing a cross-sectional view of the antenna system 10 that has been modified accordingly. In FIG. 3, the superstrate 26 has been replaced with a superstrate graded index lens 30 including three dielectric layers 32, 34 and 36 made from three materials with different dielectric constants so that the lens 30 is graded in the axial direction. The superstrate lens 30 is graded in a manner such that the layer 32 closest to the layer 14 has the highest dielectric constants, but of course, more than three layers having different levels of grading can also be provided.

FIG. 4 shows a cross-sectional view of the antenna system 10 where the superstrate 26 has been replaced by a superstrate graded index lens 38 including three separate concentric dielectric sections 40, 42 and 44 having different dielectric constants to provide for grading in the radial direction. As above, three separate sections 40-44 are shown for illustration purposes, in that other sections having different dielectric constants can also be provided. With this design, the center section 40 has the highest dielectric constant and the outer section 44 has the lowest dielectric constant. In an alternate embodiment, the antenna system 10 can be graded in both the axial and radial directions in this manner. The lens material would be a suitable low-loss composite or thermally formed polymer. The lenses 30 and 38 provide for size reduction of the antenna system 10, while providing high antenna performance by eliminating undesirable substrate modes. The radial grading of the lens would allow for the elimination of surface waves, while the axial grading would provide gradual matching of the antenna to free space to further enhance radiation efficiency.

The graded index superstrate lens design discussed above is effective for eliminating or reducing surface waves, but is limited in its operating frequency range because of current manufacturing capabilities of the lens. Particularly, the grading of the lens material is currently carried out using injection molding processes, where a composite material is injected into a host material with a varying volume fraction to achieve the desired permittivity profile. From an electrical point of view, this process introduces material losses, which become pronounced as the frequency increases. For a frequency range of interest covering FM radio bands through GPS and PCS (f<2 GHz), the material processing technique is able to provide satisfactory performance. However, for higher frequencies at C-band or X-band and higher, providing the necessary material technology is out of reach at the present time. Also, the mechanical assembly of the graded index lens using machining and processing techniques have proven to be relatively costly and not amenable to mass production.

What is needed is a dielectric slab for a planar antenna that provides a varying effective dielectric constant profile across the slab to eliminate surface and standing waves for increased performance, but does not suffer from the limitations of manufacturing referred to above. It is therefore an object of the present invention to provide such a dielectric slab.

SUMMARY OF THE INVENTION

In accordance with the teachings of the present invention, an integrated planar antenna printed on a compact dielectric slab is disclosed. The dielectric slab can be made of any dielectric material suitable for a printed antenna application that is able to accept a metalized ground plane including formed antenna elements, such as dipole slots. The slab includes vertically configured voids that are formed at certain areas in the slab to selectively control the effective dielectric constant of the material of the slab. The voids can take on any shape and configuration in accordance with a particular antenna design to optimize the effective dielectric constant for a particular application. The voids act to control the variation of the effective dielectric constant of the slab so that surface and resonant waves in the slab are controlled, thus reducing power loss in the antenna.

Additional objects, advantages and features of the present invention will become apparent from the following description and appended claims, taken in conjunction with the accompanying drawings.

BRIEF DESCRIPTION OF THE DRAWINGS

FIG. 8(*b*) shows a cross-sectional view of a planar antenna including a superstrate lens having separate sections of different hole densities to control the variation of the effective dielectric constant, according to another embodiment of the present invention;

DETAILED DESCRIPTION OF THE PREFERRED EMBODIMENTS

The following discussion of the preferred embodiments directed to a planar antenna including a dielectric slab having air voids that provide an effective dielectric constant is merely exemplary in nature, and is in no way intended to limit the invention or its applications or uses.

In accordance with the present invention, a new class of superstrate lenses used in connection with planar antennas are disclosed that provide the functionality of a graded index lens, but avoid frequency-limited material processing methods that are used to make the graded index lens. The design of the invention includes forming holes or voids in a high dielectric superstrate lens by a mechanical or laser micromachining drilling technique to alter the effective dielectric constant of the lens. In other words, by introducing air holes into the superstrate lens, the effective dielectric constant of the lens is reduced from the actual dielectric constant of the material of the lens. Providing sections with different effective dielectric constants in the superstrate lens increases antenna performance and suppresses the surface wave and resonant wave modes in the lens. This process is also aided by axial variations of the hole density, which provides a good match between the dielectric and air media. As a result, the power that would be trapped by the surface waves is released, improving power efficiency. The present invention improves power efficiency by employing high index superstrates through unidirectional radiation. The high index superstrate lens also provides size reduction or miniaturization of the antenna. The result is a planar antenna with low radar cross section and high radiation efficiency. In addition, the suppression of surface waves will improve the performance of common platform designs by minimizing interelement coupling in arrays or multifunction antennas.

Any irregularity in the material discontinuity of the superstrate lens that is distributed and small compared to the operational wavelength of the antenna can be incorporated into the macroscopic treatment of the electromagnetic phenomena by modifying the overall dielectric constant of the lens medium. In fact, the process may be quantified by comparing it to a uniform material having the effective dielectric constant that would electromagnetically behave in the same manner. The overall effective dielectric constant of the lens can be controlled by adjusting the size and the density of the holes. The higher the dielectric constant of the host material, the larger the range of effective dielectric constants that can be produced.

Figure 1:
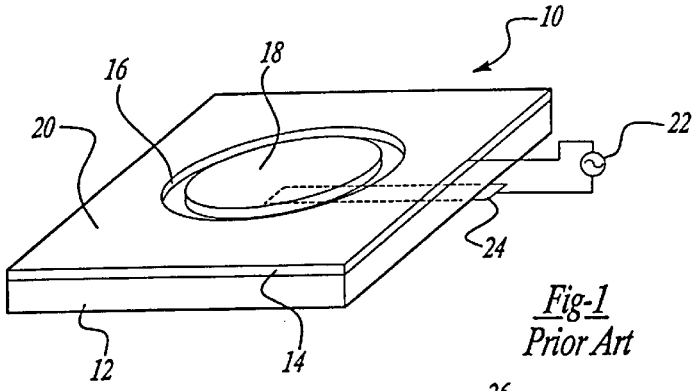
Fig-1 Prior Art
FIG. 1 is a perspective view of a known planar slot ring antenna.
Figure 2:
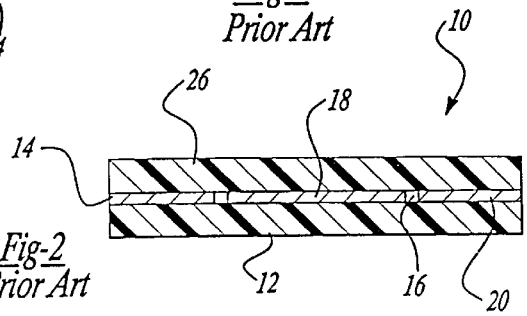
Fig-2 Prior Art
FIG. 2 is a cross-sectional view of another known planar slot ring antenna including a superstrate lens.
Figure 3:
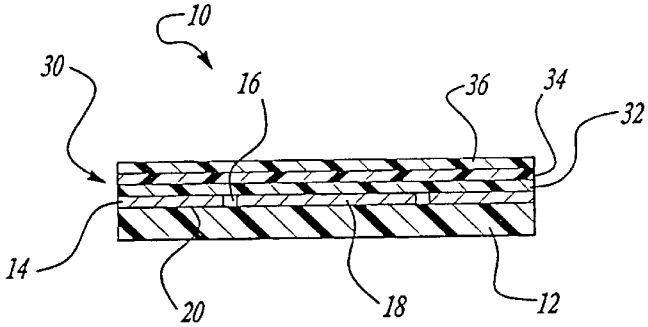
FIG. 3 is a cross-sectional view of a planar slot ring antenna including a graded index superstrate lens that is graded in an axial direction.
Figure 4:
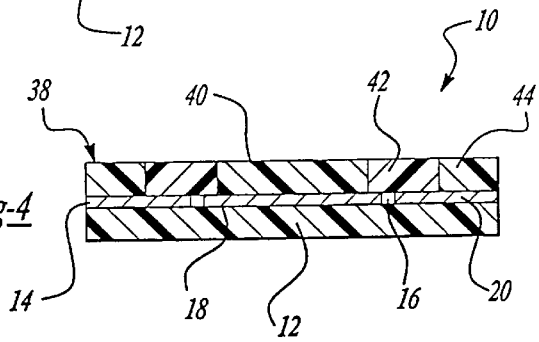
FIG. 4 is a cross-sectional view of a planar slot ring antenna including a graded index superstrate lens that is graded in a radial direction.
Figure 5:
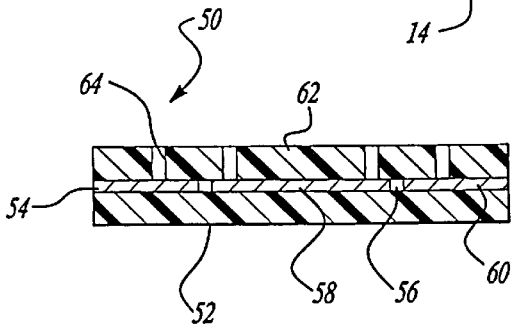
FIG. 5 is a cross-sectional view of a planar slot ring antenna including a superstrate lens having a spatially designed configuration of circular holes that change the effective dielectric constant of the lens, according to an embodiment of the present invention.

FIG. 5 shows a cross-sectional view of a planar slot ring antenna 50, similar to the antenna 10 discussed above, that illustrates the concept of the present invention. The antenna 50 includes a substrate 52 and a conductive metalized layer 54 printed on a top surface of the substrate 52. The layer 54 is patterned by a suitable patterning process to etch out a slot ring 56, and define a circular center antenna element 58 and an outside antenna element 60 on opposite sides of the ring 56. The antenna elements 58 and 60 are excited and generate currents by the received electromagnetic radiation for reception purposes, or by a suitable signal for transmission purposes, that creates an electromagnetic field across the ring 56.

Figure 6:
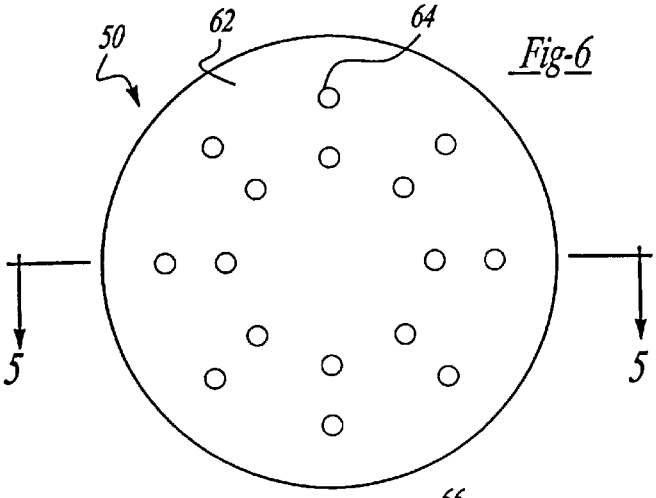
FIG. 6 is a top view of the superstrate lens shown in FIG. 5.

A high dielectric constant superstrate lens 62 is positioned on top of the layer 54, and provides the same function of miniaturization and directionality as the superstrate lenses discussed above. The lens 62 can be made of any suitable material, such as polymers, ceramics, thermoplastics, and their composites. In accordance with the teachings of the present invention, a series of air holes 64 are formed through the lens 62 in a predetermined configuration. A top view of the antenna 50 is shown in FIG. 6 to depict a typical pattern of the holes 64. Because the dielectric constant $\epsilon_r$ of air is one, the combined dielectric constant of the entire lens 62 effectively becomes less than the actual dielectric constant of the material of the lens 62.

Figure 7:
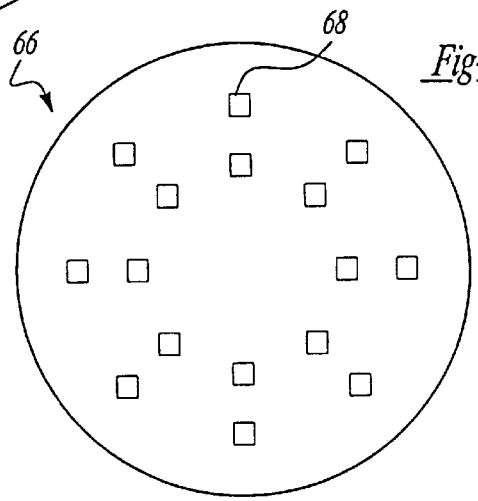
FIG. 7 is a top view of a superstrate lens having square holes, according to another embodiment of the present invention.

The holes 64 are shown in a predetermined symmetrical configuration, and extend completely through the lens 62. In alternate designs, the holes 64 may only extend through a portion of the thickness of the lens 62, and may be randomized, or specially designed in accordance with a suitable optimization scheme. Also, the holes can have different shapes. FIG. 7 shows an alternate design of a superstrate lens 66 that can replace the lens 62 including square holes 68, according to another embodiment of the present invention. The shape of the holes would be determined for each particular application based on the performance requirements, and have any realistic shape, such as circular, square, triangular, diamond, etc., as would be appreciated by those skilled in the art. Also, the holes 64 may be closed and filled with a different injected material having a predetermined dielectric constant.

By altering the dielectric constant of the superstrate lens in this manner, the manufacturing costs of the lens is considerably lower and simpler than the graded technique, and does not involve sophisticated material processing techniques. Therefore, a much higher operating frequency can be achieved. Artificial dielectrics provide an inexpensive and efficient process to realize compact common aperture antennas with multifunction capabilities that can perform at very high frequencies. The only limitation is that the irregularities or holes in the lens should be small compared to the operational wavelength. For practical purposes, a diameter of 1/20th of the operational wavelength qualifies for a "small" size. At X-band frequencies, for example, the wavelength is on the order of 3 cm, and thus, the holes should be no larger than 1.5 mm, which can comfortably be achieved using a mechanical drill. For higher frequencies, laser micromachining technology is available. It is stressed, that any combination of hole designs and patterns can be provided within the scope of the present invention, as long as the size of the holes conform with the wavelength requirements of the operational frequency of the antenna.

Figure 8A:
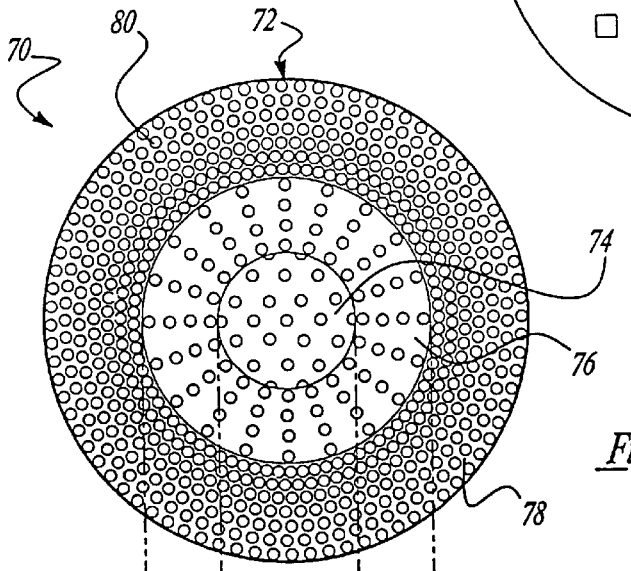
FIG. 8(*a*) shows a top view.
Figure 8B:
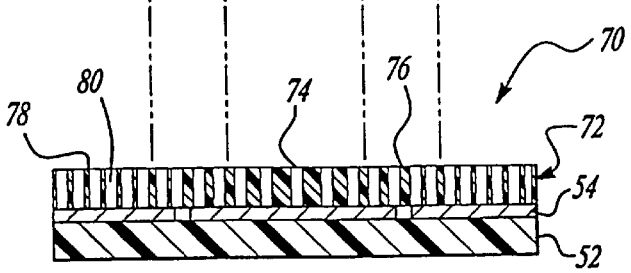

The planar superstrate lens can be designed to have sections of different hole densities in the radial (and/or axial) direction, according to the invention. This embodiment is depicted in FIGS. 8(*a*) and 8(*b*) showing a top view and a cross-sectional view, respectively, of a planar slot ring antenna 70 similar to the antenna 50 discussed above, where like elements are referenced the same. The slot ring antenna 70 includes a superstrate lens 72 that is separated into three concentric sections 74, 76 and 78. Each of the sections 74–78 has a different hole density defined by holes 80 to alter the effective permittivity of the lens 72 radially out from the center of the antenna 70 towards free space. In this specific design, the effective permittivity of the superstrate lens 72 decreases farther away from the center. Alternatively, a superstrate lens can be provided that includes different lens layers extending axially out from the antenna slot to provide a decrease in the effective permittivity and axial direction, as also discussed in this application.

Figure 9:
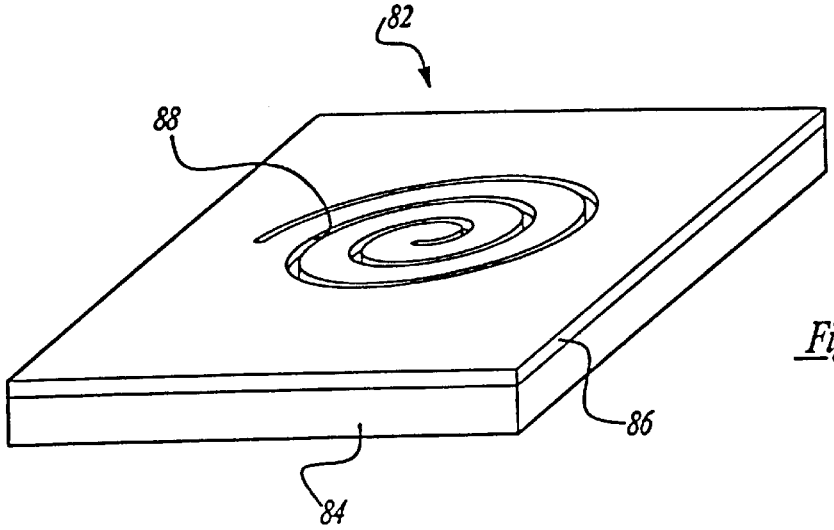
FIG. 9 is a perspective view of a planar spiral slot antenna.

The antenna 50 discussed above includes the slot ring 56 to depict the general concept of the present invention. Of course, use of a superstrate lens including a plurality of openings that alter the effective dielectric constant of the lens, according to the invention, can be used in connection with other antenna designs. FIG. 9 shows a perspective view of a planar spiral slot antenna 82 including a substrate 84 and a metalized layer 86 that has been patterned to form a spiral slot 88. Planar spiral slot antennas of this type are known to those skilled in the art. The various embodiments of the superstrate lens 62 can be used in connection with the antenna 82 for the same purposes, as discussed above. FIG. 9 is intended to illustrate that other types of planar antennas can be used in connection with the superstrate lens of the invention.

Figure 10:
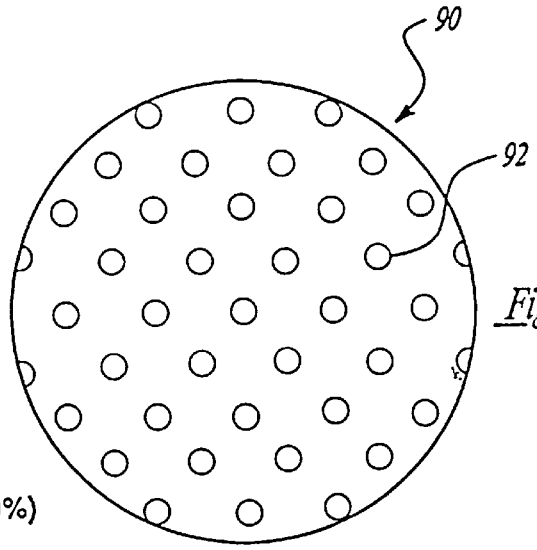
FIG. 10 shows a top view of a superstrate lens for a planar antenna of the invention depicting a random pattern of holes to provide an effective dielectric constant.

FIG. 10 shows a top view of an artificial dielectric lens 90 including a plurality of vertical holes 92 to depict a simulation geometry for demonstrating the effective permittivity of a superstrate lens of the invention. The lens 90 can be used for miniaturization, as well as for providing a unidirectional radiation pattern. In this simulation, a slot loop antenna having an inner diameter of 3 cm and a width of 0.1875 cm was used in connection with the lens 90. The lens 90 is 1.5 cm thick with a diameter of 4.5 cm and would be centered on top of the loop antenna. The antenna resonates at a frequency of 1.073 GHz, where the free space wavelength is 28 cm. The miniaturization effect is evident from the small size of the antenna/lens combination. The near field of the structure has been solved using the finite element method and the volume mesh has been truncated using a lossy dielectric layer backed by a PEC. The slot loop was excited using an ideal electric current source. The actual dielectric constant of the material of the superstrate lens 90 is 36, and the vertical holes 92 were formed through the lens 90 to control the overall effective dielectric constant to be between 36 and 1. The volume percentage of air in the lens 90 is given by $100N\ (D_h D_d)^2$, where N is the number of holes 92, $D_h$ is the diameter of the holes 92, and $D_d$ is the diameter of the lens 90.

Figure 11:
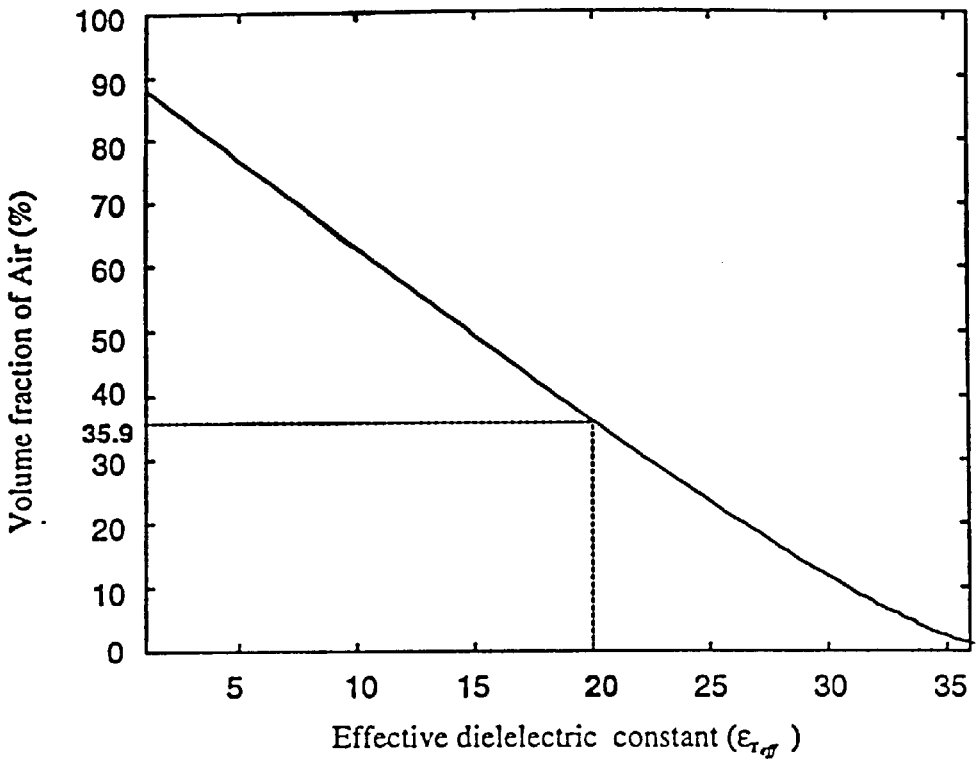
FIG. 11 is a graph with the effective dielectric constant of the lens on the horizontal axis and volume fraction of air of the lens on the vertical axis to show the relationship of hole density volume fraction to the effective dielectric constant of the superstrate lens of FIG. 10 based on resonance frequency.

When the lens 90 is used for achieving a unidirectional pattern, the ability to control the dielectric constant becomes important as it provides a means to control the front-to-back ratio (FBR) of the antenna. The FBR is the ratio of power transmitted through the superstrate lens 90 relative to the power transmitted to the substrate. As the dielectric constant of the superstrate 90 increases, the FBR should also increase. To relate the volume fraction of air to the effective permittivity, the front-to-back ratio (FBR) of the antenna was recorded for various hole densities, and a polynomial curve was fitted to relate the FBR to the volume fraction of air. Then, a uniform solid lens was used with different values of permittivity and the FBR was recorded again, with another polynomial curve fitted to relate the FBR to the uniform dielectric constant. Finally, the FBR variable was eliminated from the two curves to directly relate the volume fraction to the effective dielectric constant for the same value of the FBR, a shown in FIG. 11. The dashed line in the graph shows that to realize an effective dielectric constant of 20, a volume fraction of 35.9% is needed. FIG. 11 clearly shows that an effective dielectric constant can be simulated by forming holes in a high permittivity material. The higher the density of the holes, the lower the effective dielectric constant of the lens. This provides a cost-effective way of achieving arbitrary values of dielectric constants.

Figure 12:
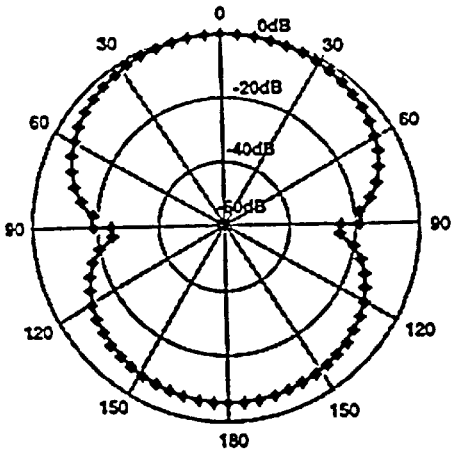
FIG. 12 is a graph showing radiation patterns comparing the performance of two equivalent antennas, one including a superstrate lens with $\epsilon_r$=36 and having air voids with a volume fraction of 35.9% and a corresponding solid superstrate lens with a uniform $\epsilon_r$=20.

To verify the equivalence between a high permittivity lens having a plurality of holes and a uniform solid lens with an effective dielectric constant, the far field radiation pattern of the antenna/lens combination was calculated for two cases: (1) with the lens 90 of FIG. 10 having a diameter of 4.5 cm, a thickness of 1.5 cm, a permittivity of 36 and the holes 92 having a volume fraction of 35.9%, and (2) with a solid lens of exactly the same dimensions but with a uniform permittivity of 20. FIG. 12 shows the radiation pattern of the two cases at the resonant frequency. It is seen that a front-to-back ratio of 5.3 dB and 52. dB is achieved in the two cases, respectively. Even the two patterns follow each other very closely for all angles.

Figure 13:
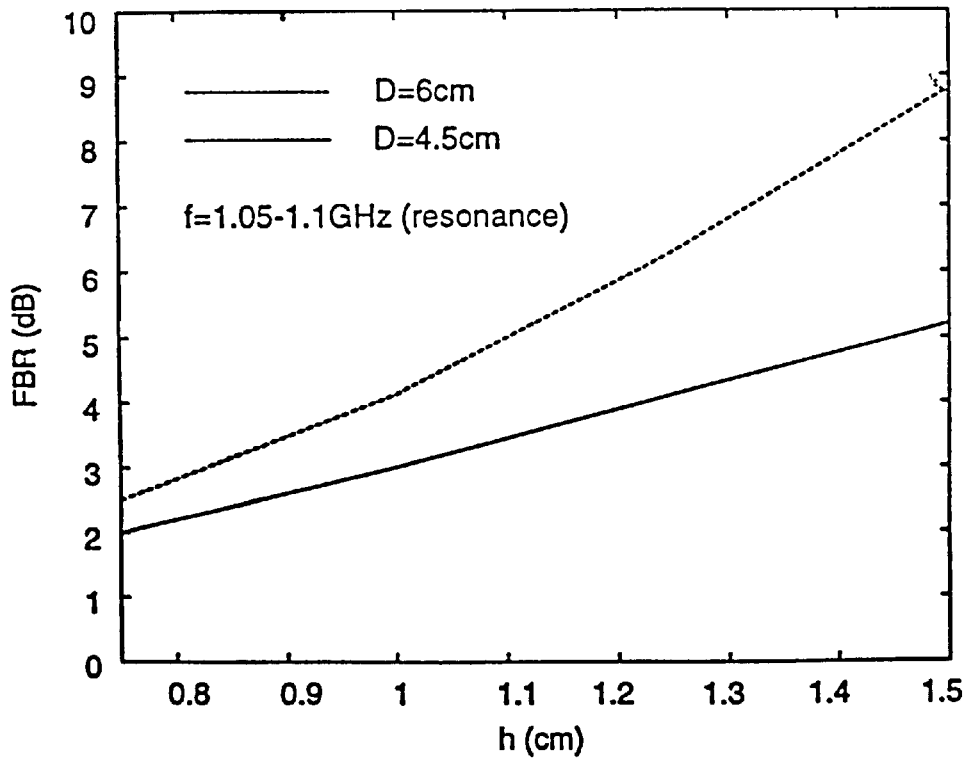
FIG. 13 is a graph showing the lens thickness on the horizontal axis and the front to back ratio (FBR) of the antenna on the vertical axis.

The radiation efficiency of the antenna increases by increasing the front-to-back ratio. The FBR is directly proportional to the volume of the superstrate lens 90. FIG. 13 shows the variation of the FBR as a function of the thickness of the lens 90 for two different values of the lens diameter, namely 4.5 cm and 6 cm. It is seen that for the same lens thickness of 1.5 cm, an FBR of 8.8 dB can be achieved if the diameter of the lens 90 is increased to 6 cm with the same dimensions of the slot antenna. This indicates that there is a trade-off between the efficiency and antenna gain and miniaturization. Given the design specifications and requirements, a minimum antenna size can be established to maintain a minimum gain requirement.

The various embodiments of the integrated planar printed antenna discussed above include a metalized ground plane layer formed on a substrate, where the particular slot antenna element or elements are formed in the ground plane. A superstrate lens is then formed over the metalized layer that has an effective dielectric constant controlled by a configuration of voids throughout the lens. In accordance with the teachings of another embodiment of the present invention, the actual substrate on which the metalized layer is formed is eliminated, and the metalized layer is patterned on the superstrate lens itself. In effect, the superstrate lens becomes the substrate, and will be referred to herein as a dielectric slab. Thus, the thickness dimension of the combination of substrates can be reduced to further reduce the size of the antenna. This is possible because direct metalization and conductive coating of ceramic blocks and dielectric slabs are now feasible from a manufacturing point of view, and are easier and more cost-effective than placing a superstrate lens on top of a printed antenna. As above, the antenna elements can be fed from the same side of the slab using a coaxial cable or a co-planar waveguide, or can be fed from an opposite side of the slab by a microstrip feed.

Figure 14:
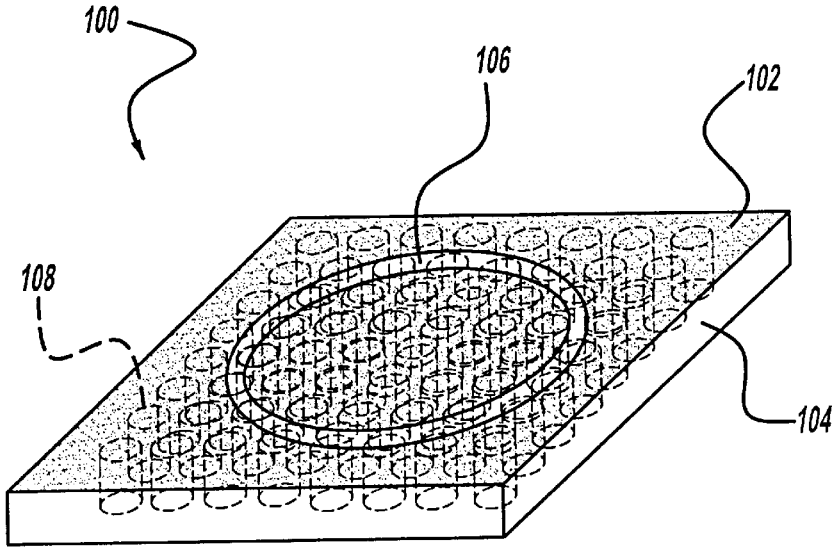
FIG. 14 is a perspective view of an integrated planar antenna printed on a compact dielectric slab, according to another embodiment of the present invention.

FIG. 14 is a perspective view of an integrated planar antenna 100 depicting this new embodiment of the invention. The antenna 100 includes a metalized ground plane 102 patterned on a dielectric slab 104 that acts as both the substrate and superstrate lens of the embodiments discussed above. A ring slot antenna element 106 is etched into the ground plane 102, and is intended to represent various types of antenna elements. The feed of the slot element 106 is not shown in this embodiment, but as will be appreciated by those skilled in the art, the feed can be provided in various ways, such as by a coaxial cable or a co-planer waveguide formed on the same side of the slab 104 as the metalized layer 102, or by a microstrip feed formed on an opposite side of the slab 104 from the metalized layer 102, where a shorting via extends through the slab 104 to electrically couple the microstrip feed to the metalized ground plane 102.

In this embodiment, a plurality of voids 108 are formed vertically through the slab 104 relative to the slot element 106 to control the effective dielectric constant of the material of the slab 104 for miniaturization purposes, as discussed above. The voids 108 can be air or another dielectric material, and have the dimensions relative to the wavelength of the resonant frequency of the slot element 106.

As discussed above, employing a high dielectric constant material for antenna miniaturization typically leads to a sharp drop in the input impedance of the antenna. Therefore, impedance matching becomes difficult in these designs. By creating voids around the feed area of the antenna, it is possible to decrease the effective dielectric constant locally, and thus increase the impedance to a reasonable value for matching purposes.

Figure 15:
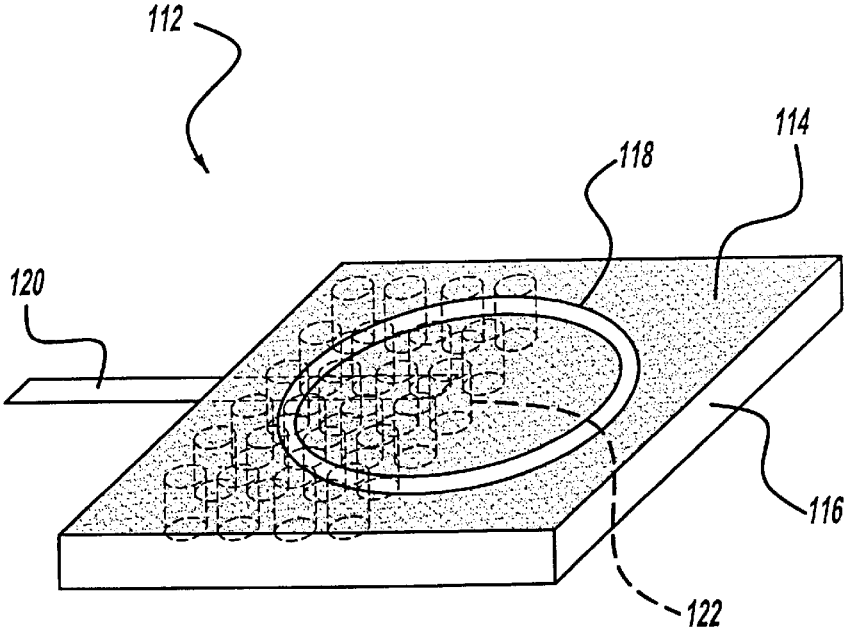
FIG. 15 is a perspective view of an integrated planar antenna printed on a dielectric slab, and including voids in the slab around a feed of the antenna, according to another embodiment of the present invention.

FIG. 15 is a perspective view of an integrated planar antenna 112 including a metalized ground plane 114 patterned on a dielectric slab 116. A dipole slot ring element 118 is etched in the ground plane 114, and is intended to represent any suitable antenna element for a printed circuit antenna of the type being discussed herein. In this embodiment, the slot element 118 is fed by a microstrip feed line 120 formed on an opposite side of the slab 116 from the ground plane 114. The microstrip feed line 120 is electrically coupled to the ground plane 114 proximate the element 118 by a shorting via (not shown) that extends through the slab 116. According to the invention, a plurality of voids 122 are created through the slab 116 around the microstrip feed line 120 to selectively decrease the effective dielectric constant locally around the feed line 120, and increase its impedance.

It is known in the art to employ multiple antenna elements having different resonant frequencies in a common antenna for receiving and transmitting different signals. Typically, the antenna elements couple to each other by surface waves inside the substrate, and effect each other's performance in an undesirable manner. According to another embodiment of the present invention, it is possible to reduce this surface wave coupling by creating voids between the antenna elements to alter the effective dielectric constant of the dielectric slab at that location.

Figure 16:
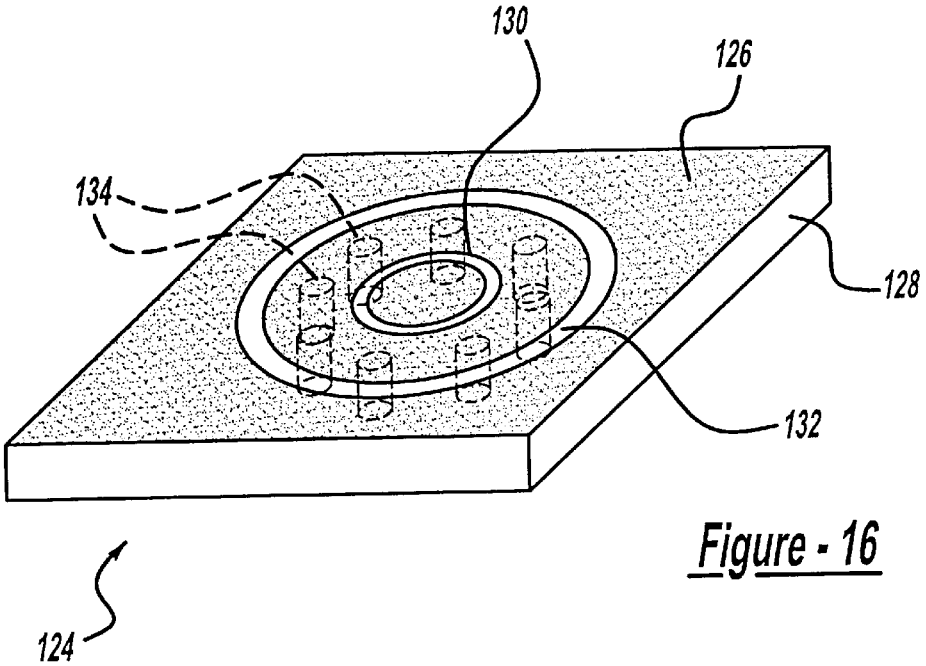
FIG. 16 is a perspective view of an integrated planar antenna printed on a compact dielectric slab including two ring antenna elements and voids in the slab between the rings, according to another embodiment of the present invention.

FIG. 16 is a perspective view of an antenna 124 illustrating this embodiment of the present invention. As above, the antenna 124 includes a metalized ground plane 126 patterned on a dielectric slab 128. Concentric slot ring elements 130 and 132 are etched in the ground plane 126, and resonate at different frequencies for different applications. In alternate embodiments additional slot rings can be provided, or parasitic coupling elements in combination with the elements 130 and 132 can be provided, within the scope of the present invention. According to the invention, a plurality of voids 134 extend through the slab 128 between the elements 130 and 132, as shown. By locally limiting the voids in this manner, the dielectric constant of the slab 128 is locally altered and the surface wave coupling between the elements 130 and 132 is reduced.

Figure 17:
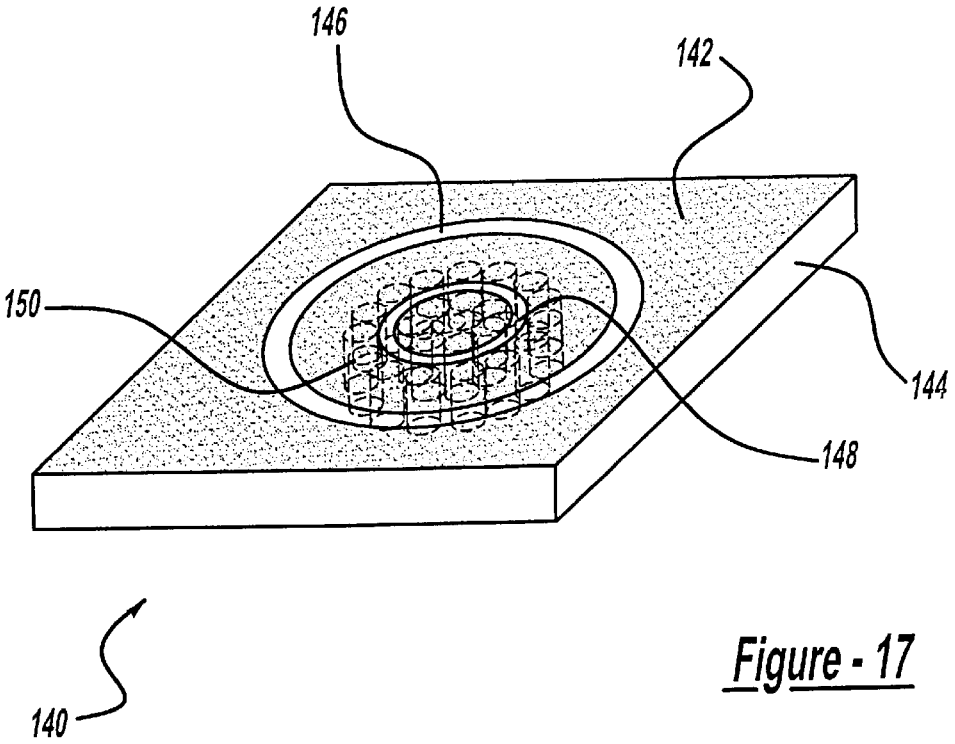
FIG. 17 is a perspective view of an integrated planar antenna printed on a compact dielectric slab including two ring antenna elements and varying void densities proximate the ring elements, according to another embodiment of the present invention.

Another way to reduce the coupling between multiple antenna elements in a printed antenna is to vary the effective dielectric constant of the slab as seen by the different elements by creating hole densities beneath them. FIG. 17 illustrates this embodiment, showing a perspective view of an antenna 140. As with the antenna 124 above, the antenna 140 includes a metalization ground plane 142, a dielectric slab 144, and dipole slot elements 146 and 148. In this embodiment, voids 150 are created vertically through the slab 144 within the inner element 148 and just outside of the inner element 148 as shown.

The foregoing discussion discloses and describes merely exemplary embodiments of the present invention. One skilled in the art will readily recognize from such discussion and from the accompanying drawings and claims, that various changes, modifications or variations can be made therein without departing from the spirit and scope of the invention as defined in the following claims.

What is claimed is:

1. An integrated planar antenna comprising:

a dielectric slab, said dielectric slab being made of a dielectric material having a material dielectric constant; and at least one antenna element patterned on the dielectric slab, said antenna elements operating at a predetermined resonant frequency, wherein the dielectric slab includes a plurality of voids extending through the slab that vary the material dielectric constant of the slab to be an effective dielectric constant that acts to reduce resonant waves in the slab, said plurality of voids being selectively locally optimized at a predetermined location in the slab so that the density of the voids is greater at some locations in the slab than at other locations in the slab, wherein the plurally of voids are locally limited between an inner antenna ring element and an outer antenna ring element.

2. The antenna according to claim 1 wherein the plurality of voids are distributed across the slab in a predetermined symmetrical configuration.

3. The antenna according to claim 1 wherein the plurality of voids extend completely through the slab.

4. The antenna according to claim 1 further comprising an antenna feed electrically coupled to the at least one antenna element, wherein the plurality of voids are also localized proximate to the feed so as to decrease the effective dielectric constant of the slab material locally around the feed.

5. The antenna according to claim 1 wherein at least one antenna element is a slot antenna element formed in a metalization ground plane patterned on the slab.

6. The antenna according to claim 1 wherein the plurality of voids have an average lateral dimension less than about 1/20th of the wave length of the resonant frequency.

7. The antenna according to claim 1 wherein the slab is separated into a plurality of radial slab sections where each section includes a different pattern of voids.

8. The antenna according to claim 1 wherein the plurality of voids are filled with a dielectric material that is different from the slab material.

9. An integrated planar antenna comprising:

a dielectric slab, said dielectric slab being made of a dielectric material having a material dielectric constant;

a metalized ground plane patterned on the slab, said ground plane including a first slot antenna element and a second slot antenna element formed therein, where the slot antenna elements are operational at a predetermined frequency band, wherein the first and second slot antenna elements are two concentric ring antenna elements; and a microstrip feed line patterned on a surface of the slab opposite to the ground plane, said feed line being electrically coupled to the antenna elements by a shorting via extending through the slab, wherein the slab includes a plurality of voids extending through the slab that vary the material dielectric constant to be an effective dielectric constant that acts to reduce resonant waves in the slab, said plurality voids being confined within an outer one of the two concentric ring antenna elements.

10. The antenna according to claim 9 wherein the plurality of voids are distributed across the slab in a predetermined symmetrical configuration.

11. The antenna according to claim 9 wherein the plurality of voids extend completely through the slab.

12. The antenna according to claim 9 wherein the plurality of voids are selectively locally optimized at a predetermined location in the slab so that the density of the voids is greater at some locations in the slab than at other locations in the slab.

13. The antenna according to claim 9 wherein the plurality of voids are also localized proximate to the feed line so as to decrease the effective dielectric constant of the slab material locally around the feed line.

14. The antenna according to claim 9 wherein the plurality of voids have an average lateral dimension less than about 1/20th of the wave length of the resonant frequency.

15. The antenna according to claim 9 wherein the slab is separated into a plurality of radial slab sections where each section includes a different pattern of holes.

16. The antenna according to claim 9 wherein the plurality of voids are filled with a material that is different from the slab material.

17. A method of providing a printed planar antenna, said method comprising the steps of:

providing a dielectric slab being made of a dielectric material having a material dielectric constant;

forming at least two concentric antenna elements on the slab that operate at a predetermined resonant frequency band; and forming a plurality of voids in the slab to vary the material dielectric constant to be an effective dielectric constant that acts to reduce resonant waves in the slab, wherein forming the voids includes forming the voids within an outer one of the at least two concentric antenna elements.

18. The method according to claim 17 wherein the step of forming a plurality of voids includes distributing the voids across the slab in a predetermined symmetrical configuration.

19. The method according to claim 17 wherein the step of forming a plurality of voids includes selectively locally forming the voids in the slab so that the density of the voids is greater at some locations in the slab than at other locations in the slab.

20. The method according to claim 17 further comprising the step of forming an antenna feed electrically coupled to the antenna elements, wherein the step of forming the plurality of voids also includes forming the voids proximate to the feed so as to decrease the effective dielectric constant of the slab material locally around the feed.

21. An integrated planar antenna comprising:

a dielectric slab, said dielectric slab being made of a dielectric material having a material dielectric constant; and at least two concentric antenna elements patterned on the dielectric slab, said antenna elements operating at a predetermined resonant frequency, wherein the dielectric slab includes a plurality of voids extending through the slab that vary the material dielectric constant of the slab to be an effective dielectric constant that acts to reduce resonant waves in the slab, said plurality of voids being selectively locally optimized at a predetermined location in the slab so that the density of the voids is greater at some locations in the slab than at other locations in the slab, wherein the plurality of voids are confined within an outer one of the at least two concentric antenna elements.

22. An integrated planar antenna comprising:

a dielectric slab, said dielectric slab being made of a dielectric material having a material dielectric constant; and at least one antenna element patterned on the dielectric slab, said antenna element operating at a predetermined resonant frequency, wherein the dielectric slab includes a plurality of voids extending through the slab that vary the material dielectric constant of the slab to be an effective dielectric constant that acts to reduce resonant waves in the slab, said plurality of voids being selectively locally optimized at a predetermined location in the slab so that the density of the voids is greater at some locations in the slab than at other locations in the slab, wherein the plurality of voids are locally positioned around and within an inner ring element.

23. An integrated planar antenna comprising:

a dielectric slab, said dielectric slab being made of a dielectric material having a material dielectric constant;

a metalized ground plane patterned on the slab, said ground plane including a first slot antenna element and a second slot antenna element formed therein and being operational at a predetermined frequency band, wherein the first and second antenna elements are two concentric antenna elements; and a microstrip feed line patterned on a surface of the slab opposite to the ground plane, said feed line being electrically coupled to the antenna elements by a shorting via extending through the slab, wherein the slab includes a plurality of voids extending through the slab that vary the material dielectric constant to be an effective dielectric constant that acts to reduce resonant waves in the slab, said plurality voids being limited between an inner antenna ring element and an outer antenna ring element.

24. An integrated planar antenna comprising:

a dielectric slab, said dielectric slab being made of a dielectric material having a material dielectric constant;

a metalized ground plane patterned on the slab, said ground plane including a first slot antenna element and a second slot antenna element formed therein and being operational at a predetermined frequency band, wherein the first and second antenna elements are concentric ring antenna elements; and a microstrip feed line patterned on a surface of the slab opposite to the ground plane, said feed line being electrically coupled to the antenna elements by a shorting via extending through the slab, wherein the slab includes a plurality of voids extending through the slab that vary the material dielectric constant to be an effective dielectric constant that acts to reduce resonant waves in the slab, said plurality of voids being locally positioned around and within an inner ring element.

25. A method of providing a printed planar antenna, said method comprising the steps of:

providing a dielectric slab being made of a dielectric material having a material dielectric constant;

patterning at least one antenna element on the slab that operates at a predetermined resonant frequency band; and forming a plurality of voids in the slab to vary the material dielectric constant to be an effective dielectric constant that acts to reduce resonant waves in the slab, wherein forming the voids includes forming the plurality of voids to be locally limited between an inner antenna ring element and an outer antenna ring element.

26. A method of providing a printed planar antenna, said method comprising the steps of:

providing a dielectric slab being made of a dielectric material having a material dielectric constant;

patterning at least one antenna element on the slab that operates at a predetermined resonant frequency band; and forming a plurality of voids in the slab to vary the material dielectric constant to be an effective dielectric constant that acts to reduce resonant waves in the slab, wherein forming the voids includes forming the plurality of voids to be locally positioned around and within an inner ring element.

* * * * *

UNITED STATES PATENT AND TRADEMARK OFFICE

CERTIFICATE OF CORRECTION

PATENT NO. : 6,509,880 B2
DATED : January 21, 2003
INVENTOR(S) : Sabet et al.

It is certified that error appears in the above-identified patent and that said Letters Patent is hereby corrected as shown below:

Title page,
Item [56], References Cited, U.S. PATENT DOCUMENTS, "5,606,335 A 2. 1997 English et al." should be -- 5,606,355 … --.

Column 1,
Line 53, "A" should be -- $\lambda$ --.
Line 59, "HF/UHFNHF" should be -- HF/UHF/VHF --.

Column 8,
Line 57, "a" should be -- as --.

Signed and Sealed this

Ninth Day of August, 2005

JON W. DUDAS
*Director of the United States Patent and Trademark Office*